US005102780A

United States Patent [19]

Terashima et al.

[11] Patent Number: 5,102,780

[45] Date of Patent: Apr. 7, 1992

[54] SILVER HALIDE PHOTOGRAPHIC PHOTOSENSITIVE MATERIAL

[75] Inventors: Eiichi Terashima; Seiichi Sumi; Kazuhisa Kobayashi; Yoshio Shibata, all of Nagaokakyo, Japan

[73] Assignee: Mitsubishi Paper Mills Limited, Tokyo, Japan

[21] Appl. No.: 514,968

[22] Filed: Apr. 26, 1990

[30] Foreign Application Priority Data

Apr. 27, 1989 [JP] Japan ..... 1-109674

[51] Int. Cl.[5] ..... G03C 1/76

[52] U.S. Cl. ..... 430/533; 430/539; 430/621

[58] Field of Search ..... 430/621, 533, 539

[56] References Cited

U.S. PATENT DOCUMENTS 4,503,134 3/1985 Matsumoto et al. ..... 430/621
4,820,613 4/1989 Vermeersch et al. ..... 430/621
4,826,757 5/1989 Yamada et al. ..... 430/621
4,874,687 10/1989 Itabashi et al. ..... 430/621
4,879,209 11/1989 Vermeersch et al. ..... 430/621

*Primary Examiner*—Jack Brammer
*Attorney, Agent, or Firm*—Cushman, Darby & Cushman

[57] ABSTRACT

The present invention provides a silver halide photographic photosensitive material excellent in dimensional stability which comprises a polyethylene terephthalate film support and, provided thereon, at least one gelatin layer containing an active halogen type hardener, wherein water content in the gelatin layer is 20% by weight or less based on total amount of gelatin. Further provided is a method for producing such silver halide photographic photosensitive material which comprises coating a gelatin coating solution containing an active halogen type hardener on a polyethylene terephthalate film support and then drying the coat, wherein the coat is dried so that water content based on total amount of gelatin is 20% by weight or less and then, is subjected to a heat treatment.

10 Claims, No Drawings

SILVER HALIDE PHOTOGRAPHIC PHOTOSENSITIVE MATERIAL

BACKGROUND OF THE INVENTION

The present invention relates to a silver halide photographic photosensitive material and a method for producing it. More particularly, it relates to method for producing a silver halide photographic film photosensitive material having polyethylene terephthalate support and excellent in dimensional stability.

Ordinarily, fiber ester (hereinafter referred to as "triacetate"), polyethylene terephthalate (hereinafter referred to as "polyester") or the like is used as a support in silver halide film photosensitive materials. However, with reference to expansion and shrinkage of film photosensitive material, when a polyester support of 100 μm thick is used, rate of dimensional change per change of 1° C. in temperature is $1\times10^{-3}$% and rate of change per change of 1% in relative humidity is $1.5\times10^{-3}$%. Furthermore, in the case of triacetate support, the rate of change is $3\times10^{-3}$% per change of 1° C. in temperature and the rate of change per change of 1% in relative humidity is $4.5\times10^{-3}$%, namely, it shows changes of 3 times that of the polyester support. This expansion and shrinkage (dimensional change) cause problems in the field where dimensional accuracy is required For example, in the case of film for plate making used in the field of printing, four color printing as in color printing is carried out and unless the four colors overlap perfectly with each other, attractive prints cannot be obtained. Furthermore, increase in the size of print and complication of prints such as the complicated expression of letters require improvement in accuracy of dimensional stability of film for plate making. In this field of printing, film photosensitive materials for plate making in which polyester is used as support is also mainly used, but those which are satisfactory in dimensional stability have not yet been obtained and the severe control of the environment in use (temperature, humidity) has been conducted.

As techniques for improvement of dimensional stability, incorporation of polymer latex into silver halide emulsion is disclosed, for example, in Japanese Patent Kokoku (Post Exam. Publn.) Nos. 39-4272, 45-5331 and 55-47371 and Japanese Patent Kokai (Laid-Open) Nos. 61-251844 and 63-244031. However, there are problems in the production of photosensitive materials and in the quality such as adverse effects on photographic performances, loss loss of clarity in development, the increase of viscosity of the coating solution, the deterioration of double-coatability and repelling in coating.

Many hardeners for hardening gelatin-containing layers are known and among them, active halogen type hardeners are well known as excellent hardeners having high film hardening properties. For example, various active halo9en type hardeners and methods for use thereof are disclosed in Japanese Patent Kokoku (Post Exam. Publn.) Nos. 39-16928, 43-2602, 47-6151, 47-33380 and 48-13709 and Japanese Patent Kokai (Laid-Open) Nos. 48-3527, 48-31937, 51-9434, 51-78788, 52-60612, 52-127229, 54-15958 and 56-27135.

These hardeners are added to the coating solution for the photographic layer before coating on the support and the coating solution is coated and dried and then wound up. The photographic coat immediately after coating and drying contains the hardener in the unreacted state with the binder and the film strength of the coat is not yet high enough to stand photographic treatment. The reaction of such unreacted hardener with the binder still proceeds after coating and drying of the photographic layer and so when the photographic material is left to stand for a long time before shipping, a film strength high enough to stand cannot be controlled by such a method and especially dimensional stability which requires accuracy cannot be controlled at all. Therefore, heating of the coat is carried out to accelerate the reaction of hardener, but for further acceleration of the reaction, the water content in the gelatin layer must be increased and, in general, the heating is carried out while keeping the water content of 22–25% by weight based on the weight of gelatin.

In the case of laminated paper (RC base) or triacetate film base, the amount of water contained in the base is large and this assists the hardening reaction during heating and the limiting of water content is not needed. These bases are essentially inferior in dimensional stability and are not used for a purpose which requires accuracy.

As a result of intensive research conducted by the inventors on dimensional stability, it has been found that the water content in gelatin layer containing an active halogen type hardener has a great effect on the dimensional stability. That is, it is proposed to reduce the water content and to carry out heating treatment under severer conditions than conventional treatment (for example, by prolonging heating time, raising the temperature, increasing the amount of hardener, etc.).

SUMMARY OF THE INVENTION

The object of the present invention is to provide a silver halide photographic film photosensitive material which is superior in dimensional stability and is inhibited from being stained with dye after development treatment and a method for producing such photosensitive material.

That is, the present invention is a silver halide photographic photosensitive material comprising a polyethylene terephthalate film support and, provided thereon, a gelatin layer containing an active halogen type hardener, characterized in that the water content based on total amount of gelatin is 20% by weight or less. Furthermore, the preferred method for producing the photosensitive material is a method which comprises coating a gelatin coating solution containing an active halogen type hardener on a polyethylene terephthalate film support and drying the coat, characterized in that the coat is dried so that water content based on total amount of gelatin reaches 20% by weight or less and is then subjected to heat treatment.

DESCRIPTION OF THE INVENTION

The water content of silver halide photographic photosensitive material is indicated by total amount of water contained in silver halide emulsion layer, gelatin-containing protective layer, backing layer, and the like and is measured, for example, by a method of measuring heated and dried weight. Example of instrument for measurement is an electronic moisture meter (MC-30MB manufactured by Cho Meter Manufacturing Co.).

As is well known, photographic photosensitive material is produced at present by coating one or more photographic coating solutions by various coating methods such as dip coating, air knife coating, extrusion coating and curtain coating on a running support and drying it and then winding up the coated support on a core. The drying of the coating layer is performed in the following manner. That is, the coat is coagulated (so-called setting) in a cooling zone just after the support is coated utilizing the sol-gelation phenomenon of gelatin and thereafter the temperature is gradually raised through a period of preheating of the material, a constant rate drying period in which the evaporation amount of solvent per unit time, namely, the evaporation rate of the solvent is constant, and a falling rate drying period in which the evaporation rate of the solvent gradually decreases and finally substantially no evaporation proceeds (where water content in the coating layer becomes equilibrium under nearly atmospheric humidity and temperature conditions) and thus the drying is completed. Usually, the drying zone is set so that the maximum drying temperature is about 40° C. - about 60° C.

The photographic photosensitive material which has left the drying zone is, if necessary, subjected to moisture conditioning and sent to a winding-up chamber where it is wound up on a core in the form of a roll. Usually, the winding-up chamber is air-conditioned under the constant conditions of room temperature (such as 15°-25° C.) and normal humidity (such as 40-60% in relative humidity).

Heating treatment of the material after being wound up may be carried out successively just after completion of winding up or may be carried out after lapse of some period, but preferably the heat treatment is begun in a short time from completion of winding up. Heating conditions must be suitably determined depending on addition amount of hardener, pH and the like, but temperature is preferably 35°-50° C. and time is preferably 5-15 days. The most important thing is that the heating treatment is carried out with the water content of silver halide photographic photosensitive material being 20% by weight or less based on the weight of gelatin. If the water content is more than 20% by weight, dimensional stability of the material is inferior and color staining with dye occurs long after development treatment. The preformed water content is about 15-20% by weight.

As other generally known hardeners, there are aldehydes such as formaldehyde and glyoxal, N-methylol compounds such as dimethylolurea and mucohalogenic acids such as mucochloric acid. When these hardeners are used, hardening of the layer can be attained nearly regardless of water content of photographic photosensitive material. However, use of them is very difficult because use of them may cause the reduction of image density, deterioration of the dot quality of photosensitive material for the printing plate and have significant effects on the feeding properties in automatic developing machines.

Active halogen type hardeners used in the present invention are known compounds as mentioned in the patent specifications mentioned herebefore.

Typical preferable examples of the active halogen type hardeners are dichloro-S-triazines such as, for example, 2,4-dichloro-6-hydroxy-l,3,5-triazine (alkali metal salts), 2,4-dichloro-6-methoxy-1,3,5-triazine, 2,4-dichloro-6-ethylamino-l,3,5-triazine, and 2,4-dichloro-6-hydroxyethylamino-l,3,5-triazine.

The active halogen type hardener can be used in one or more photographic layers and can also be diffused from the layer into adjacent photographic layers. The addition amount is usually about 0.005-5 mmol per 1 g of gelatin. The stage of addition may be any time before coating of the photographic coating solution. The addition of the hardener may be carried out by known methods.

Such a hardener may be used in combination with other hardeners, but the main component should be the active halogen type hardener. Hardening accelerators may also be used.

The silver halide emulsion used in the present invention can be prepared by known customary methods. There are no special limitations in the method of formation and dispersion of silver halide, the composition of silver halide, the size and crystal habit of silver halide grains, the proportion of silver halide and gelatin, the pH and pAg of silver halide emulsion, the kind and amount of chemical sensitizers, the kind and amount of other additives, and the kind and amount of gelatin and other binders.

The silver halide photographic photosensitive material has a non-photosensitive backing layer (hereinafter referred to as "backing layer") on the side of the support opposite to the side on which the emulsion layer is provided. This backing layer comprises a hydrophilic colloid such as gelatin as a binder and contains matting agent, antistatic agent, thickening agent, surfactant, dye and the like. This backing layer may have a singlelayer structure or a multi-layer structure including an interlayer, a protective layer and others It is preferred to use the above active halogen type hardener also as a main hardener in the backing layer.

The coating amounts of gelatin on the photosensitive layer side and the backing layer side of the silver halide photographic photosensitive material of the present invention are preferably 2-6 g/m$^2$, respectively.

The silver halide photographic photosensitive materials of the present invention explained in detail hereabove may be, for example, photosensitive films for printing plates (such as lith film), films for high speed photographing, microfilms, and X-ray films The following nonlimiting examples further explain the present invention.

COMPARATIVE EXAMPLE

A silver chlorobromide emulsion containing 95 mol% of silver chloride was prepared by precipitating silver halide by conventional methods using 100 mg of adenine and $10^{-5}$ mol of rhodium chloride per 1 mol of silver, desalting and redissolving it and to this emulsion were added 50 mg of pinakryptol yellow and 400 mg of thiosalicylic acid as organic desensitizers per 1 mol of silver halide, 2 g of sodium tridecanepolyethersulfonate as a surfactant per 1 liter of the emulsion, and glyoxal, vinyl sulfone, 2,4-dichloro-6-hydroxy-S-trizine (Na salt) or chrome alum as a hardener in an amount as shown in Table 1. This emulsion was coated in an amount of 3.5 g/m$^2$ in terms of silver and in a gelatin amount of 6 g/m$^2$ on one side of a subbed triacetate film together with a gelatin solution for protective layer (gelatin 1 g/m$^2$). On another side of the triacetate film was coated a gelatin solution containing a mixture of the following dyes (A), (B) and (C) (1:1:1) at a gelatin coating amount of 3 g/m$^2$. Hardeners used in this backing layer were the same as those used on the emulsion side and amounts thereof were also the same as those on the emulsion side.

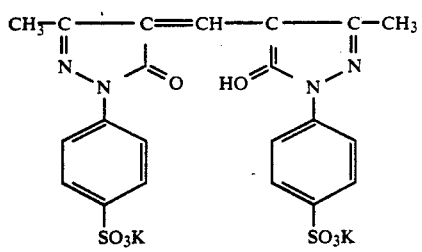

Dye (A)

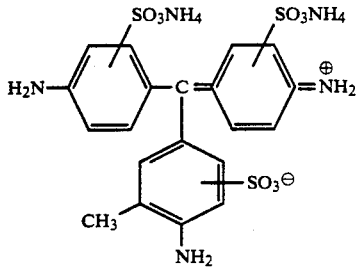

Dye (B)

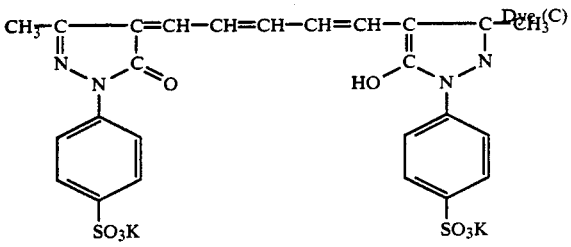

Dye (C)

Thereafter, the coated material was dried and water content thereof at winding up was adjusted to 19% by weight based on total gelatin amount to obtain samples. These samples were packaged in a moistureproof packaging material containing aluminum and were subjected to heat treatment at 40° C. for 7 days.

Test (1): Dye removability

The dye removability was tested by the automatic developing machine GR-14 manufactured by Konishiroku Photo Industry Co., Ltd. The development was carried out with MRA-CD developer manufactured by Mitsubishi Paper Mills Ltd. at 38° C. and the fixing solution MRA-CF manufactured by Mitsubishi Paper Mills Ltd. was used at 38° C. The drying was conducted at 40° C. Ten films after being subjected to the treatment were superposed and visual evaluation was conducted by five grades. Grade 5 means the best level and 1 and 2 mean undesirable levels.

Test (2): Dimensional stability

Two parallel fine lines of 50 μm in width were drawn at an interval of 500 mm on a transparent glass plate and the sample was exposed thereto by a roomlight printer and then this sample was subjected to the same development treatment as in the above test (1). The thus developed sample was left to stand for 3 hours and thereafter, the sample was again superposed on the above transparent glass plate and the one gage line of the glass plate and the one gage line printed on the sample were exactly overlapped with each other and the deviation of another line printed on the sample from another gage line on the glass plate was accurately read using a 100X magnifier having a scale. The degree of this deviation was expressed by the rate of dimensional change per 500 mm. The sample of less than $1\times10^{-3}$% in this rate of change is shown by grade 5; that of $1\times10^{-3}-3\times10^{-3}$% is shown by grade 4; that of $3\times10^{-3}-6\times10-3$% is shown by grade 3; that of $6\times10^{-3}-1\times10^{-2}$% is shown by grade 2, and that of more than $1\times10^{-2}$% is shown by grade 1. Samples of grades 2 and 1 are practically undesirable. The results are shown in Table 1.

TABLE 1

| Sample No. | Hardener | Addition amount (mM/g-Gel) | Dye removability | Dimensional stability |
|---|---|---|---|---|
| 1 | Glyoxal | 0.1 | 1 | 1 |
| 2 | Vinyl sulfone | 0.08 | 4 | 1 |
| 3 | S-triazine | 0.07 | 3 | 1 |
| 4 | Chrome alum | 0.12 | 1 | 1 |

As is clear from Table 1, samples 1–4 were inferior in dimensional stability. This is because triacetate film was used and it can be seen that the use of triacetate film in combination with the hardeners cannot provide materials having satisfactory dimensional stability.

EXAMPLE 1

The samples were prepared in the same manner as in the above comparative example except that a subbed polyester film was used and the water content at winding up was adjusted to 19% by weight and 22% by weight. The packaging and heat treatment were carried out in the same manner as in the comparative example. The heat treatment of the sample adjusted to 19% by weight in water content was carried out for a longer time than that of the sample adjusted to 22% by weight in water content to attain hardening of the same degree in both of these samples. The results obtained are shown in Table 2.

TABLE 2

| Sample No. | Hardener | Addition amount (mM/g-Gel) | Water content 19 wt % | | Water content 22 wt % | |
|---|---|---|---|---|---|---|
| | | | Dye removability | Dimensional stability | Dye removability | Dimensional stability |
| 5 | Glyoxal | 0.1 | 1 | 3 | 1 | 3 |
| 6 | Vinyl sulfone | 0.08 | 1 | 2 | 2 | 3 |
| 7 | S-triazine | 0.07 | 5 | 5 | 4 | 1 |
| 8 | Chrome alum | 0.12 | 1 | 3 | 1 | 3 |

As is clear from Table 2, the sample 7 which contained S-triazine as a hardener was superior in the removability of dye, but was much superior in dimensional stability in comparison to other samples when water content was low. It is also clear that other hardeners were inferior in dye removability.

Example 2

The emulsion was prepared in the same manner as in the above comparative example except that 2,4-dichloro-6-hydroxy-S-triazine (Na salt) was used as a hardener and gelatin solution for the backing layer was prepared in the same manner as in the comparative example except that 2,4-dichloro-6-hydroxy-S-triazine (Na salt) was used as a hardener. These were coated on a subbed polyester film and dried in the same manner as in the comparative example. The water content per total amount of gelatin at winding up was adjusted to 17, 19, 21, 23 and 25% by weight. The resulting samples were packaged and subjected to heat treatment in the same manner as in the comparative example and Example 1 to obtain nearly the same degree of hardening in these samples. The result obtained are shown in Table 3.

TABLE 3

| | Sample No. | Water content (wt %) | Dye removability | Dimensional stability |
|---|---|---|---|---|
| The present invention | 9 | 17 | 5 | 5 |
| | 10 | 19 | 5 | 5 |
| Comparative Example | 11 | 21 | 4 | 3 |
| | 12 | 23 | 3 | 1 |
| | 13 | 25 | 1 | 1 |

As is clear from Table 3, sample Nos. 9 and 10 of the present invention were superior in dye removability and dimensional stability. On the other hand, sample Nos. 11-13 which were high in water content were inferior to those of the present invention in both the dye removability and the dimensional stability.

According to the present invention, excellent photographic material superior in dye removability and dimensional stability can be obtained by adjusting the water content of the material to 20% by weight or less based on the total amount of gelatin when a polyester film is used as a support and an active halogen type hardener is used.

What is claimed is:

1. A silver halide photographic photosensitive element comprising:

a polyethylene terephthalate film support, a silver halide emulsion layer on a side of said support to form a photosensitive side of said support, at least one gelatin layer on the photosensitive side of the support, separate from the silver halide emulsion layer, and a 2,4-dichloro-1,3,5-triazine salt, as a hardener, contained in at least one of said emulsion layer and said gelatin layer in the amount of about 0.005–about 5 mmol per 1 gram of gelatin, wherein said emulsion layer and said gelatin layer contain gelatin in the amount of about 2–about 6 g/mu 2, and a water content of said element, after said element is coated and dried, is 20% by weight or less based on total amount of gelatin on said element.

2. A silver halide photographic photosensitive element according to claim 1, wherein the water content in the emulsion layer and the gelatin layer is about 15–20% by weight.

3. A silver halide photographic photosensitive element according to claim 1, wherein, opposite said photosensitive side is a backing side comprising a gelatin-containing backing layer.

4. A silver halide photographic photosensitive element according to claim 3, wherein the backing layer comprises:

gelatin in the amount of about 2–about 6 g/m$^2$, and an active halogen type hardener.

5. A silver halide photographic photosensitive element comprising:

a polyethylene terephthalate film support, a silver halide emulsion layer on a side of said support to form a photosensitive side of said support, containnig gelatin in the amount of about 2– about 6 g/m$^2$, and a 2,4-dichloro-1,3,5-triazine salt, as a hardener, contained in at least one of said emulsion layer and said gelatin layer in the amount of about 0.005– about 5 mmol per 1 gram of gelatin, a water content of said element, after said element is coated and dried, being 20% by weight or less based on total amount of gelatin on said element.

6. A silver halide photographic photosensitive element according to claim 5, wherein the water content in the emulsion layer is about 15–20% by weight.

7. A silver halide photographic photosensitive element according to claim 5, wherein the active halogen type hardener is a dichloro-S-triazine.

8. A silver halide photographic photosensitive element according to claim 5, wherein content of the hardener is about 0.005–about 5 mmol per 1 g of gelatin.

9. A silver halide photographic photosensitive element according to claim 5, wherein, opposite said photosensitive side is a backing side comprising a gelatin-containing backing layer.

10. A silver halide photographic photosensitive element according to claim 9, wherein the backing layer comprises:

gelatin in the amount of about 2– about 6 g/m$^2$, and an active halogen type hardener.

* * * * *